US006516776B1

(12) United States Patent
Kai et al.

(10) Patent No.: US 6,516,776 B1
(45) Date of Patent: Feb. 11, 2003

(54) THROTTLE VALVE DEVICE OF ENGINE

(75) Inventors: Keiichi Kai, Atsugi (JP); Masato Kumagai, Atsugi (JP)

(73) Assignee: Unisia Jecs Corporation, Kanagawa (JP)

( * ) Notice: Subject to any disclaimer, the term of this patent is extended or adjusted under 35 U.S.C. 154(b) by 24 days.

(21) Appl. No.: 09/693,969

(22) Filed: Oct. 23, 2000

(30) Foreign Application Priority Data

Oct. 21, 1999 (JP) ..... 11-300252

(51) Int. Cl.[7] ..... F02D 9/00; F01P 1/06
(52) U.S. Cl. ..... 123/337; 123/41.31
(58) Field of Search ..... 123/399, 361, 123/336, 337, 41.13, 41.31

(56) References Cited

U.S. PATENT DOCUMENTS 4,934,341 A * 6/1990 Otsuka et al. ..... 123/361
5,666,930 A * 9/1997 Elder ..... 123/41.31
5,884,587 A * 3/1999 Ichihara ..... 123/41.01
6,067,958 A * 5/2000 Kamimura et al. ..... 123/337
6,186,127 B1 * 2/2001 Everingham ..... 123/568.12

FOREIGN PATENT DOCUMENTS

JP 63-74731 * 4/1988 ..... B60K/31/02
JP 2-55842 * 2/1990 ..... F02D/9/02
JP 9-287485 11/1997
JP 11-210501 8/1999

* cited by examiner

*Primary Examiner*—Hieu T. Vo
(74) *Attorney, Agent, or Firm*—Sughrue Mion, PLLC

(57) ABSTRACT

In a throttle valve device for driving a throttle valve to open/close by an electric motor, wherein a circuit case for accommodating a motor drive circuit is integrally formed to a throttle body, said throttle body is further equipped with a cooling water passage for cooling said motor drive circuit with the engine cooling water.

20 Claims, 2 Drawing Sheets

THROTTLE VALVE DEVICE OF ENGINE

FIELD OF THE INVENTION

The preset invention relates to a throttle valve device used for controlling an intake air quantity of an automotive engine, and especially, to a throttle valve device for driving the throttle valve to open/close by an electric motor.

DESCRIPTION OF THE RELATED ART

Heretofore, a throttle valve device of an automotive engine comprising a throttle body, a throttle valve rotatably supported by the throttle body, and an electric motor for rotating the throttle valve has been known (refer for example to Japanese Unexamined Patent Publication Nos. 9-287485 and 11-210501).

In a vehicle utilizing such a throttle valve device, a control unit for controlling the engine, which is provided separately from the throttle valve device, installs therein a drive circuit for driving the electric motor. In general, the engine control unit of the engine directly controls the electric motor.

As for the electric motor equipped in the throttle valve device, either a direct-current motor or an alternating-current motor is used according to the condition of use. Further, since required output torque differs according to the displacement of the engine or the bore size of the intake passage, different types of electric motors are used corresponding to different types of vehicles.

According to the prior art, there is a need to change the specifications of the drive circuit installed in the control unit for controlling the engine corresponding to the change of electric motor, and many types of control units having different specifications corresponding to various types of electric motors must be prepared, causing a problem of increase of the manufacturing cost, and reduction of the productivity.

SUMMARY OF THE INVENTION

The present invention aims at solving the above mentioned problems in the prior art. The object of the invention is to provide a throttle valve device of an engine capable of easily managing the combination of an electric motor and a drive circuit which are in a compatible relation, without having to prepare many kinds of control units in order to correspond to the change in specification of the electric motor.

In order to achieve the above object, the present invention is constituted such that a motor drive circuit is mounted to a throttle body separately from a control unit.

According to this constitution, the drive circuit compatible with the electric motor used in the throttle valve device is mounted to the throttle body, while the separately mounted control unit controls the electric motor via the drive circuit. Accordingly, even when drive circuits having different specifications are needed for various types of electric motors, the control unit can be standardized. Moreover, the combination of the electric motor and the drive circuit is fixed for every throttle body, to thereby easily manage the combination of the electric motor and the drive circuit.

The motor drive circuit may be cooled with the cooling water (i.e., a cooling liquid) of the engine.

According to this constitution, even when elements constituting the motor drive circuit, such as transistors, generate heat, heat radiation is accelerated by using the cooling water of the engine thereby improving the durability and reliability of the motor drive circuit.

Even further, a circuit case may be formed integrally to the periphery of the throttle body for accommodating the motor drive circuit therein.

According to this constitution, the motor drive circuit can be easily mounted to the throttle body while reducing the number of parts.

Moreover, when forming the circuit case integrally to the periphery of the throttle body, a connector may be provided to the circuit case for connecting the motor drive circuit to the control unit (peripheral device) and to the electric motor.

According to this constitution, the motor drive circuit can be easily and reliably connected to the motor drive circuit and to the electric motor.

These and other objects and aspects of the present invention will become apparent from the following description on the preferred embodiments of the invention with reference to the accompanied drawings.

The other objects and features of this invention will become understood from the following description with reference to the accompanying drawings.

DETAILED DESCRIPTION OF THE PREFERRED EMBODIMENT

Figure 1:
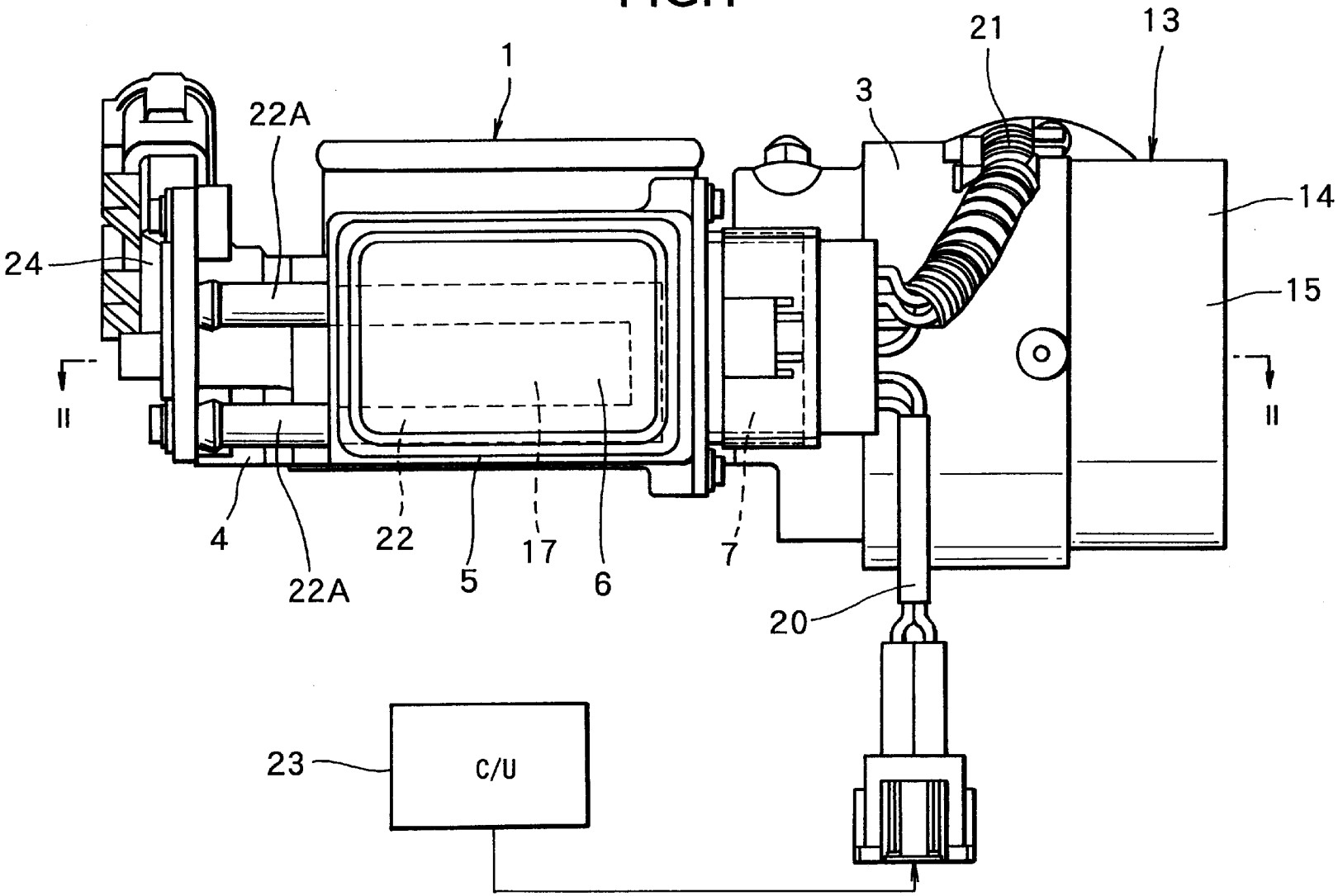
FIG. 1 is a front view showing a throttle valve device according to an embodiment of the present invention.
Figure 2:
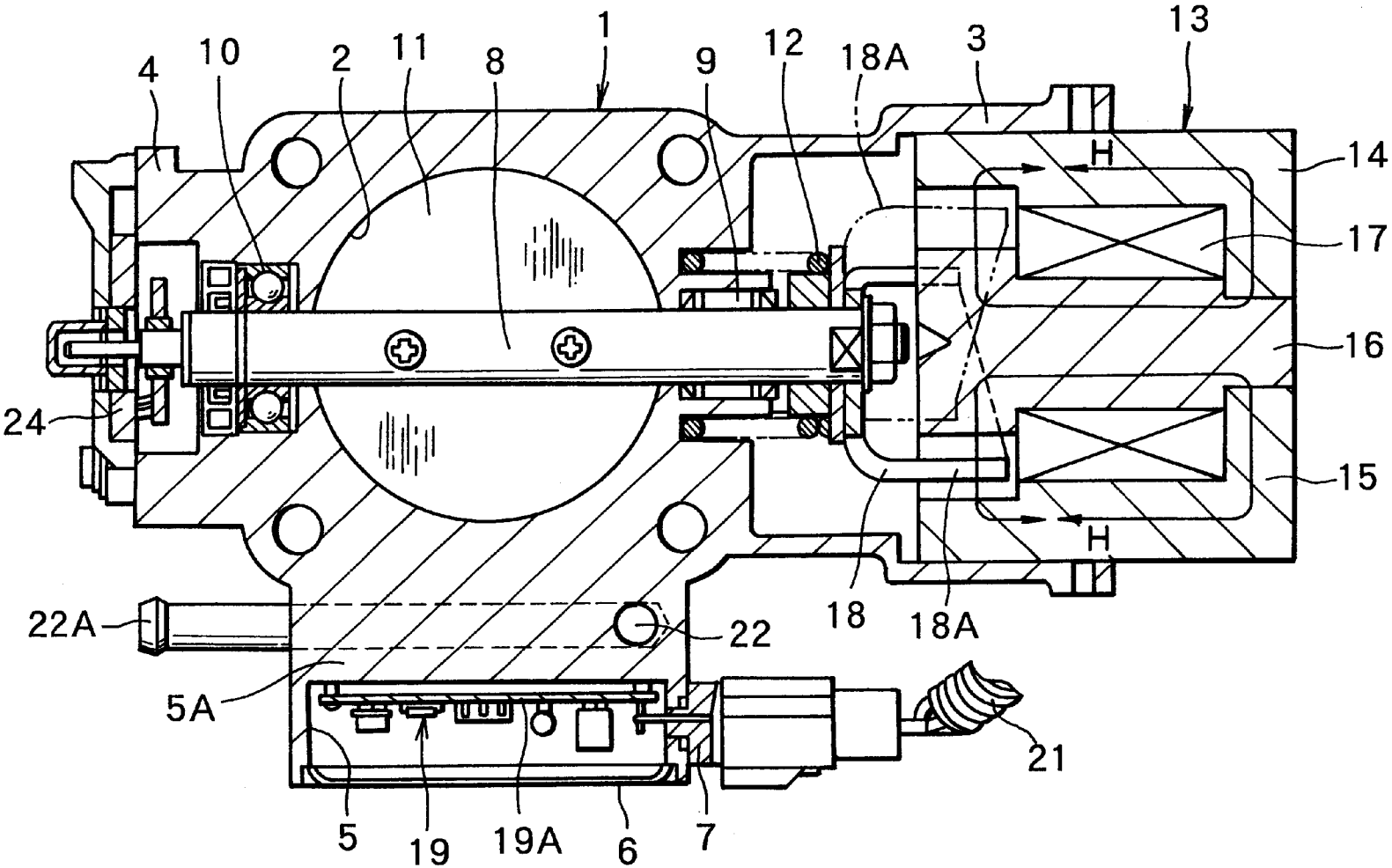
FIG. 2 is a cross-sectional view showing the throttle valve device according to the embodiment, along the line II—II of FIG. 1.

An embodiment of a throttle valve device of an engine according to the present invention will now be explained in detail with reference to FIGS. 1 and 2.

According to the figures, a throttle body 1 formed for example of aluminum die-cast is constituted by integrally forming a substantially tubular throttle chamber 2 connected to the middle of an intake passage (not shown) of the engine, a substantially tubular motor case 3 arranged on one axial direction side of a valve shaft 8 supported rotatably in a radial direction of the throttle chamber 2, a sensor case 4 arranged on the other axial direction side of the valve shaft 8, and a circuit case 5.

The circuit case 5 is integrally provided to the throttle body 1, and accommodates a motor drive circuit 19 therein. As shown in FIGS. 1 and 2, between the motor case 3 and the sensor case 4, the circuit case 5 is formed into a box having a bottom with an opening opened to the outer side in the radial direction of the throttle chamber 2, in other words, to the outer side in a radial direction of the valve shaft 8, and is arranged in parallel with the axis of the valve shaft 8 at a position separate from the valve shaft 8.

A cover 6 covers the opening of the circuit case 5, and in the closed space is mounted the motor drive circuit 19.

A cooling water passage (i.e., cooling liquid passage) 22 is embedded within the throttle body 1 constituting a bottom 5A of the circuit case 5. Further, a connector 7 is provided to the circuit case 5 to be connected to the motor drive circuit 19.

The valve shaft 8 is rotatably supported by the throttle body 1 through bearings 9 and 10. As shown in FIG. 2, the valve shaft 8 penetrates the throttle chamber 2 in the radial direction, with one end protruded into the motor case 3 and the other end protruded into the sensor case 4.

The throttle valve 11 is formed in a disk shape, having a diameter that matches the inner diameter of the throttle chamber 2. The throttle valve 11 is positioned within the throttle chamber 2 and integrally fixed to the center of the longitudinal direction of the valve shaft 8, thereby enabling to open and close the throttle chamber 2 according to the rotation of the valve shaft 8. When the valve shaft 8 is rotated by an electric motor 13, the throttle valve 11 opens and closes the intake passage of the engine, thereby variably controlling an intake air quantity of the engine according to the opening of the throttle valve.

A return spring 12 is mounted between the throttle body 1 and the valve shaft 8, which urges constantly the valve shaft 8 in a direction to close the throttle valve 11.

The electric motor 13 including a stator 14, a rotor 18 and the like, is equipped inside the motor case 3 of the throttle body 1, and arranged in line with the valve shaft 8 to be connected to one side of the valve shaft 8. In response to a drive signal output from the motor drive circuit 19, the electric motor 13 rotates the valve shaft 8, so as to open and close the throttle valve 11.

The stator 14 is fixed within the motor case 3 of the throttle body 1. As shown in FIG. 2, the stator is composed of an outer core 15, an inner core 16, and an electromagnetic coil 17.

The outer core 15 is a substantially tubular core having a bottom fitted inside the motor case 3. The inner core 16 is a cylindrical core having a step-portion fitted to the interior of the outer core 15. The cores 15 and 16 are formed of a soft magnetic material having weak retention, such as silicon steel.

Moreover, the cores 15 and 16 are equipped with opposing surfaces (not shown) that are opposed to the outer peripheral and the inner peripheral of opposing surfaces 18A of the rotor 18 to be described later.

The electromagnetic coil 17 is wound around the outer peripheral of the inner core 16 of the stator 14. When power is supplied from the motor drive circuit 19, the coil 17 generates a magnetic field H.

The rotor 18 is a substantially tubular rotor having a bottom that is fixed in a detent manner to one end of the valve shaft 8. The rotor 18 is formed of soft magnetic material similar to that of the cores 15 and 16, and includes arc-like opposing surfaces 18A, 18A that are opposed to each other with the valve shaft 8 therebetween. The respective tip portions of the opposing surfaces 18A, 18A are sloped in the circumferential direction.

Furthermore, the rotor 18 is constituted so that when rotating in the direction to open the throttle valve 11, the opposing area of the opposing surfaces 18A, 18A and the opposing surfaces of the cores 15 and 16 are gradually increased.

Thereby, when power is supplied to the electromagnetic coil 17, the opposing area between the opposing surface 18A of the rotor 18 and the opposing surface of the stator 14 are increased, and magnetic attraction force is generated towards a direction increasing the amount of magnetic flux passing through the opposing surfaces. This attraction force becomes a rotational driving force that rotates the valve shaft 8 in a direction to open the throttle valve 11.

As mentioned, the motor drive circuit 19 is accommodated inside the circuit case 5 of the throttle body 1. As shown in FIGS. 1 and 2, the motor drive circuit 19 includes plural circuit parts comprising a power transistor and the like mounted on a substrate 19A, and is arranged at a position radially outward from the throttle chamber 2 and in parallel to the valve shaft 8.

Moreover, the motor drive circuit 19 is connected to a control unit 23 via a wiring 20 for signal input that extends from the connector 7 of the circuit case 5, and is also connected to the electromagnetic coil 17 of the electric motor 13 via a wiring 21 for signal output that extends from the connector 7.

The motor drive circuit 19 outputs a pulse drive signal to the electric motor 13 in response to command signals output from the control unit 23, and changes the duty ratio of the drive signal, to drive the electric motor 13 so that the rotational drive force corresponding to the duty ratio is generated.

The cooling water passage 22 is a substantially C-shaped cooling water passage that is bored within the throttle body 1. As shown in FIGS. 1 and 2, the cooling water passage 22 is formed between the throttle chamber 2 and the motor drive circuit 19, and is positioned on the side of the bottom portion 5A of the circuit case 5.

Moreover, the cooling water passage 22 has cooling water discharge openings on both ends thereof which are connected to a cooling water passage of the engine through pipe joints 22A, 22A protruded to the exterior of the throttle body 1. Thereby, engine cooling water that has passed through a radiator (not shown) and the like of a vehicle is circulated within the cooling water passage 22.

Accordingly, the cooling water passage 22 functions as a cooling device capable of cooling both the electric motor 13 and the motor drive circuit 19 by the engine cooling water that flows through the passage, and thereby separates thermally the electric motor and the motor drive circuit from each other. Further, the engine cooling water within the cooling water passage 22 prevents the throttle valve 11 from freezing and being stuck in the throttle chamber 2 during low temperature in cold places.

The control unit 23 is provided to the vehicle separately from the throttle body 1. By detecting for example the accelerator operation of a driver, the control unit outputs command signals corresponding to the detected operation amount to the motor drive circuit 19, to perform the open/close control of the throttle valve 11 via the electric motor 13.

Moreover, a throttle sensor 24 is accommodated inside the sensor case 4 of the throttle body 1. The throttle sensor 24 comprises a potentiometer and the like equipped between the sensor case 4 and the valve shaft 8, and detects the rotary angle of the valve shaft 8 as the opening of the throttle valve 11, to output detection signals to the control unit 23.

The throttle valve device according to the present embodiment is constituted as explained above. Next, the operation of the throttle valve device is explained.

During driving the vehicle, when the accelerator pedal operation of the driver is detected by the control unit 23, according to the degree of accelerator pedal operation, the control unit 23 sets a target opening of the throttle valve 11. Then, in the control unit 23, a basic command signal is set according to the target opening, and at the same time, feedback correction portion is set using the detection signal from the throttle sensor 24. The basic command signal is corrected by the feedback correction portion, to be output to the motor drive circuit 19. Upon receiving the command signal, the motor drive circuit 19 outputs a drive signal corresponding to the command signal to the electric motor 13.

Thereby, the electric motor 13 generates the rotational drive force in the direction to open the valve corresponding to the level of the drive signal, to thereby rotate the valve shaft 8 in the direction to open the valve by a rotary angle corresponding to the drive signal, against the force of the return spring 12, thereby opening the throttle valve 11 within the throttle chamber 2.

During operation of the electric motor 13, the heat generated from the electromagnetic coil 17 is radiated to the engine cooling water that circulates through the cooling water passage 22, and the electric motor 13 is cooled. At this time, the motor drive circuit 19 also generates heat while supplying power to the electric motor 13, but the circuit is also cooled by the engine cooling water.

Since the motor drive circuit 19 is mounted to the throttle body 1 according to the present embodiment, even if there is a need to provide various types of motor drive circuits 19 corresponding to the design specification and the like of each electric motor 13, the various electric motors 13 and the corresponding various motor drive circuits 19 can be mounted integrally to the throttle body 1.

Therefore, the need to provide many varieties of control units 23 corresponding to various design specifications of the electric motor 13 can be eliminated. Thus, the control unit 23 can be standardized to correspond to various electric motors 13, reducing the time and cost spent on design of control unit and management of parts, and improving the productivity as a whole.

Moreover, since the cooling water passage 22 through which engine cooling water circulates is provided at the position of the bottom portion 5A side of the circuit case 5, the heat generated from circuit members such as the power transistor and the like constituting the motor drive circuit 19 is radiated efficiently to the engine cooling water passing through the cooling water passage 22, and the motor drive circuit 19 can be stably cooled. Therefore, the durability and the reliability of the motor drive circuit 19 can be improved.

Further, the circuit case 5 having the opening opened to the outerside in the radial direction of the throttle chamber 2 (valve shaft 8) that is covered by the cover 6 is provided to the throttle body 1, and the cooling water passage 22 is equipped on the bottom portion 5A side of the circuit case 5. Therefore, the heat generated by the electric motor 13 can be securely prevented from being conducted to the interior of the circuit case 5, thereby eliminating deterioration due to the heat of the motor drive circuit. The cooling efficiency can be even further improved by integrally forming the circuit case 5 to the throttle body 1 using aluminum die-cast.

Moreover, since the motor drive circuit 19 is mounted on the outer side in the radial direction of the throttle chamber 2 and in parallel to the axis of the valve shaft 8, and the cooling water passage 22 is equipped between the throttle chamber 2 and the motor drive circuit 19, the heat generated from the electromagnetic coil 17 of the electric motor 13 can be efficiently released to the engine cooling water, to prevent the heat from being conducted to the motor drive circuit 19 side.

Moreover, by providing the cooling water passage 22 in the throttle body 1, the throttle body 1 can be kept warm by the engine cooling water (warm water) circulating within the cooling water passage 22 during cold time in cold areas, thus preventing the throttle valve 11 from freezing and being stuck in the throttle chamber 2.

According to the present embodiment, the cooling water passage 22 is formed in a C-shape. However, the present invention is not limited thereto, and the cooling water passage may also be meandered, for example.

According further to the present embodiment, the circuit case 5 is integrally formed with the throttle body 1 by aluminum die-cast. However, the present invention is not limited thereto, and a separately formed circuit case may be fixed to the throttle body 1 by screw means and the like.

The entire contents of Japanese Patent Application No. 11-300252 filed on Oct. 21, 1999 is incorporated herein by reference.

We claim:

1. A throttle valve device of an engine that is cooled by a cooling liquid including:

a throttle body;

a throttle valve rotatably supported by said throttle body;

an electric motor for driving said throttle valve to open/close;

a motor drive circuit mounted to said throttle body; and a cooling device for cooling said motor drive circuit with the cooling liquid used for cooling said engine.

2. The throttle valve device of an engine according to claim 1, wherein a circuit case for accommodating said motor drive circuit therein is integrally formed to the periphery of said throttle body.

3. The throttle valve device of an engine according to claim 2, wherein said circuit case is formed in a box-shaped having an opening opened to the outer side in a radial direction of the throttle body, and said opening of said circuit case is covered by a cover.

4. The throttle valve device of an engine according to claim 3, wherein said motor is a rotary type motor.

5. The throttle valve device of an engine according to claim 2, wherein said circuit case is equipped with a connector for connecting said motor drive circuit to a peripheral device and to said electric motor.

6. The throttle valve device of an engine according to claim 5, wherein said motor is a rotary type motor.

7. The throttle valve device of an engine according to claim 2, wherein said motor drive circuit is arranged in straight to a valve shaft.

8. The throttle valve device of an engine according to claim 7, wherein said motor is a rotary type motor.

9. The throttle valve device of an engine according to claim 2, wherein said motor is a rotary type motor.

10. The throttle valve device of an engine according to claim 1 wherein said motor is a rotary type motor.

11. A throttle valve device of an engine that is cooled by a cooling liquid including:

a throttle body;

a throttle valve rotatably supported by said throttle body;

an electric motor for driving said throttle valve to open/close;

a motor drive circuit mounted to said throttle body; and a cooling device for cooling said motor drive circuit with the cooling liquid used for cooling said engine, wherein a circuit case for accommodating said motor drive circuit therein is integrally formed to the periphery of said throttle body, and wherein said cooling device comprises a cooling liquid passage for cooling said motor drive circuit, said cooling liquid passage being embedded within said throttle body constituting said circuit case.

12. The throttle valve device of an engine according to claim 11, wherein pipe joints constituting a cooling liquid supply opening for supplying cooling liquid to said cooling liquid passage and a cooling liquid discharge opening for discharging cooling liquid from said cooling liquid passage are formed to said throttle body, said cooling liquid passage being connected to a cooling device of said engine through said pipe joints.

13. The throttle valve device of an engine according to claim 12, wherein said moter is a rotary type moter.

14. The throttle valve device of an engine according to claim 11, wherein said cooling liquid passage is embedded within a lower surface of said motor drive circuit.

15. The throttle valve device of an engine according to claim 14, wherein said motor is a rotary type motor.

16. The throttle valve device of an engine according to claim 11, wherein said cooling liquid passage has a C-shaped portion and is embedded within a lower surface of said motor drive circuit.

17. The throttle valve device of an engine according to claim 16, wherein said motor is a rotary type motor.

18. The throttle valve device of an engine according to claim 11, wherein said motor is a rotary type motor.

19. The throttle valve device of an engine according to claim 18, wherein said motor is a rotary type motor.

20. The throttle valve device of an engine according to claim 11, wherein said motor is a rotary type motor.

* * * * *